United States Patent [19]

Rozner et al.

[11] Patent Number: 5,000,093

[45] Date of Patent: Mar. 19, 1991

[54] WARHEAD CASING

[75] Inventors: Alexander G. Rozner, Potomac; William S. Filler, Bethesda, both of Md.

[73] Assignee: The United States of America as represented by the Secretary of the Navy, Washington, D.C.

[21] Appl. No.: 190,526

[22] Filed: Sep. 25, 1980

[51] Int. Cl.[5] ..... F42B 11/24

[52] U.S. Cl. ..... 102/364; 102/464; 102/514; 102/516; 102/517; 102/519; 419/2; 419/42

[58] Field of Search ..... 102/364, 464, 514, 516, 102/517, 519; 75/214; 419/2, 42

[56] References Cited

U.S. PATENT DOCUMENTS 3,000,308 9/1961 Land et al. ..... 102/473
3,119,332 1/1964 Grebe et al. ..... 86/20 C

FOREIGN PATENT DOCUMENTS 669449 8/1963 Canada .

OTHER PUBLICATIONS

Hirschhorn, *Introduction to Powder Metallurgy* (1969) pp. 2–4, 107–109, 127, 130–132, 139–145.

*Primary Examiner*—Peter A. Nelson
*Attorney, Agent, or Firm*—Kenneth E. Walden; Thomas McDonnell

[57] ABSTRACT

A method for producing an energistic porous warhead casing comprises the steps of mixing aluminum and magnesium powders in an Al:Mg weight ratio from about 22:78 to about 28:72, isostatically pressing said powders to form a preform of appropriate shape and with a density from about 20 to about 40 percent of the theoretical density, and heating said preform in an inert atmosphere at a temperature from 350 C to about 425 C until the density reaches 60 to 70 percent of the theoretical density.

20 Claims, 1 Drawing Sheet

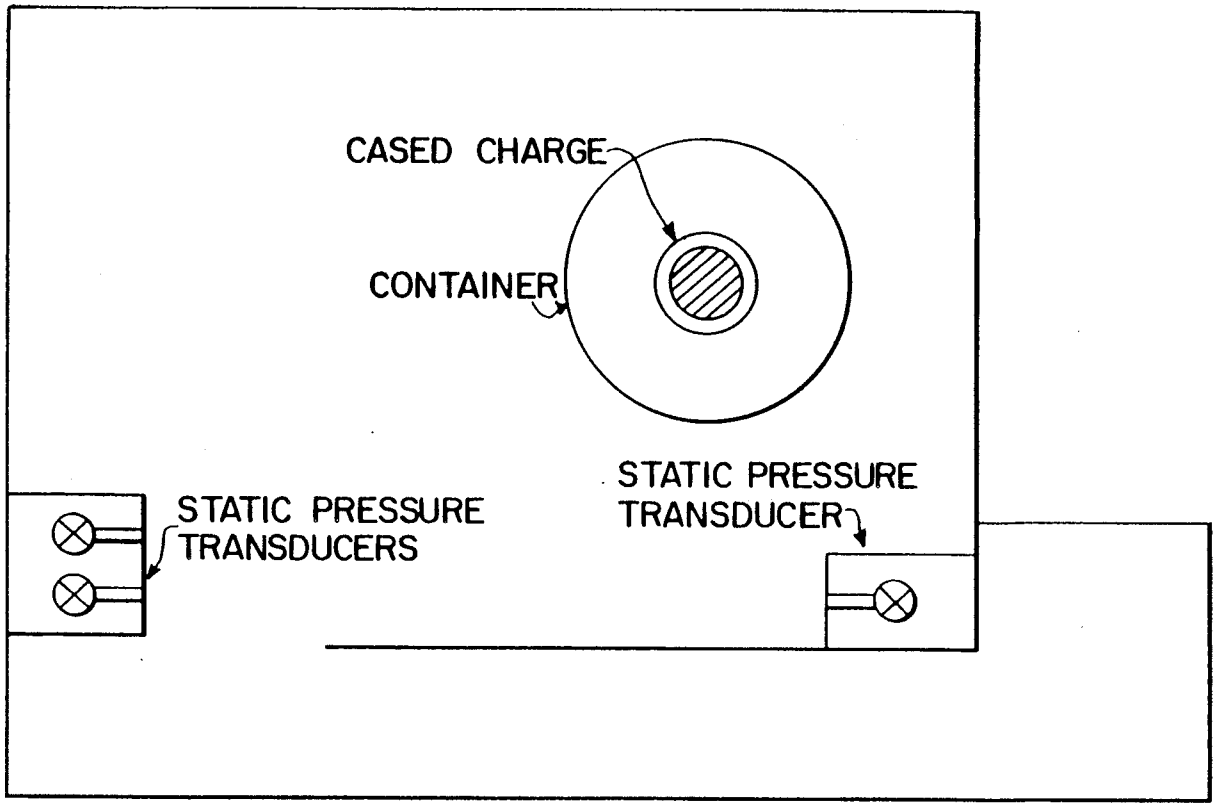
CASED CHARGE
CONTAINER
STATIC PRESSURE TRANSDUCERS
STATIC PRESSURE TRANSDUCER

WARHEAD CASING

BACKGROUND OF THE INVENTION

The present invention pertains generally to explosives and in particular to energetic casings for warheads.

Aluminum and alloys thereof have been used extensively in explosives as a powder metal fuel for detonation. It has been disclosed in U.S. Pat. No. 3,000,308 that aluminum can contribute to the energy of an explosive without being in a powder, e.g., ribbon, foil, or strip. Thus, if aluminum is added to an explosive composition in a nonpowder form as a reinforcement aid, the energy contents of the composition is not significantly reduced.

The use of aluminum or aluminum alloys in the manufacture of warhead casing has been limited. In U.S. Pat. No. 2,998,772 it was disclosed that PBX explosives do not need a strong casing and thus a thin sheet aluminum could be used as the casing. Nothing was disclosed in regard to the use of aluminum in a casing requiring mechanical strength or about the possible contribution of aluminum or its alloys to the air-blast energy. In G.B. Patent No. 1,018,089 it was disclosed that aluminum was not suited for the production of casings for blasting cartridges because aluminum produces large spinters upon detonation. Iron which had been pressed and sintered was taught to be the best casing material, even though the mechanical strength and imperviousness to fluid were considered to be poor.

The large contribution that aluminum can make to an airblast was first realized in U.S. patent application No. 494,957. The patent application taught broadly that the controlling factors were a large percentage of aluminum in the warhead casing and the porosity in the warhead casing. The manner of fabricating the warhead casing was considered to be unimportant and that no alloy had particular advantage over aluminum or other alloys. Although the tested warhead casing made from commercially available pressed aluminum foam showed a large increase in the air-blast efficiency, the warhead casings would only have a very limited use because of the poor mechanical strength, its absorption of water, high cost of manufacture arising from the complexity and length of processing.

SUMMARY OF THE INVENTION

An object of the present invention is to obtain a reactive warhead casing with a significantly improved internal blast efficiency and effectiveness.

A further object of the present invention is to reduce the cost and time in fabricating porous aluminum-containing warhead casings.

Another object of the present invention is to improve the uniformity of the porosity of porous aluminum containing warhead casing.

And another object of the present invention is to produce a porous aluminum-alloy warhead casing with an improved mechanical strength.

And yet another object of the present invention is to produce a porous aluminum alloy warhead casing which has a low rate of water absorption.

These and other objects are achieved by selecting aluminum powder and magnesium powder of a particle size and uniformity necessary to produce a porous casing with a uniform porosity mixing said powders in a weight ratio corresponding to a low melting point but a high reaction energy, applying an isostatic pressure to the powder mixture to form a preform releasing said pressure, and by sintering said compact at a temperature below the melting point of said compact but at a temperature sufficient to produce bonding in said compact by solid state diffusion. The sintering should continue for a period of time necessary to obtain a density from 60 to 70 percent of theoretical density.

BRIEF DESCRIPTION OF THE DRAWING

The FIGURE is a schematic of the test apparatus used to determine the airblast efficiency of warhead casings.

DETAILED DESCRIPTION OF THE INVENTION

The many remarkable improvements, e.g., a hundredfold decrease in fabrication time and cost, and approximately 15 percent improvement in air blast efficiency over the previous porous warhead casing, and improved mechanical strength of a warhead casing of the present invention arises from several discoveries. It was discovered that aluminum and magnesium having a certain particle size and uniformity and mixed in a narrow mole ratio range can be worked into a warhead casing by the inexpensive and fast operation of cold compacting and sintering, provided that the pressure, time, and temperature are controlled to within narrow ranges. A warhead casing made from this mixture of metal powders was discovered to have a significantly improved airblast efficiency over solid or porous aluminum warhead casing, even though aluminum is more engergetic than magnesium. It was also discovered that a warhead casing with sufficient strength and imperviousness to water for use in a torpedo can be fabricated easily by sintering, if magnesium and aluminum powders with a certain particle size and uniformity are mixed in a certain ratio and isostatically compacted to within a certain density range.

Fabrication of the warhead casing of the present invention begins with mixing aluminum powder with magnesium powder in a Al-Mg weight ratio from about 78:22 to about 72:28 and preferably from 76:24 to 74:26. The powders have a particle size up to 150 microns and preferably up to 100 microns. It is necessary that the average particle size of the aluminum is within 80% and preferably less than 50% of the average particle size of magnezium and that the variation among the particle sizes is less than 80% and preferably less than 50%.

After mixing the powders, the powder mixture is isostatically pressed into a hollow cylinder with an L/d ratio of 1.8:1 to 3.3:1 and preferably from 2:1 to 2.5:1. The L/d ratios are necessary to produce a warhead casing having sufficient mechanical strength to withstand the pressures encountered in a firing of a torpedo. If the powders are isostatically pressed into another configuration, e.g., a solid cylinder, machining is necessary to obtain a warhead configuration. This machining is performed after the compressed powder structure has been sintered to achieve a density of from 60 to 70% as described below.

The preferred isostatic-pressing technique comprises placing the powder mixture in a rubber mold, submerging the mold in hydraulic fluid, applying a pressure from about 35,000 to 50,000 psi and preferably from 40,000 to 45,000 psi at room temperature. If the pressure is less than 35,000 psi, the resulting product has very poor strength and if the pressure is in excess of 50,000 psi the porosity is too small. The pressing is continued until the density of the product is from about 20 to 40 percent of the theoretical density and preferably from 30 to 35 percent of theoretical density.

The pressed powder mixture is sintered in a non-oxidizing atmosphere, e.g., helium or argon at a temperature from about 350 to about 425 C. and preferably from 375 to 400 C. until the density reaches from about 60 to 70% and preferably from 63 to 68% theoretical density. If the temperature is much below 350 C., the rate of fusion which binds the powder particles together is too slow and the produced bonding is too weak. On the other hand, if the temperature is in excess of 425 C. the diffusion proceeds too quickly and some melting occurs which decreases the porosity and the uniformity of the distribution of the pores.

The warhead casing is allowed to cool to room temperature at a rate sufficient to avoid creating thermal stresses. Generally, a cooling time of about 1/2 hour to 1 hour is sufficient to cool the cylinder to room temperature without any detrimental effect.

The following examples are given by way of illustration and are not meant to limit this disclosure or the claims to follow in any manner.

EXPERIMENTAL SECTION I

Apparatus and Test

The apparatus used in the following small-scale tests is shown in the FIGURE, which is a schematic representation of a bombproof with a total space volume of about 1000 cu. ft. Three inductance-type transducers with related FM-tape recording channels provided data on each shot. The gauges had a frequency response of 5000 Hertz, two orders of magnitude greater than necessary for these measurements, and were thermally insensitive. The gauges, mounted within the bombproof, were protected by the steel boxes surrounding them. The cased charge was detonated in a hollow steel cylinder with an unattached fifty-pound steel lid, referred to in the FIGURE as the container.

The small scale tests are based on the phenomon of equilibrium or static pressure of an explosion in an enclosed space prior to rupture being directly proportional to the energy released by the charge. Its maximum value, if no venting occurs, is determined approximately by the expression:

$$\Delta P = \frac{\gamma h W(-1)}{V}$$

wherein ΔP is the static chamber pressure rise when a given weight, W, of reactive and/or explosive material with a heat of combustion, h, is initiated in a volume, V, of air with a ratio of specific heat, γ.

The test method comprised detonating a encased charge weighing about 90 grams in the container which caused the container to vent, increasing the pressure in the bombproof. This pressure increase was measured by the gauges.

EXPERIMENTAL SECTION II

Preparation of Warhead Casings

Aluminum powder (75 g) with an average particle size 60 microns was intimately mixed with magnesium powder (25 g) having an average particle size of 60 microns in a mixing bowl. A rubber mold in the shape of a cylinder with an diameter of 5 cm, and a length of 2 cm was filled with the powder mixture, taking care to ensure no void was present. The mold was submerged in hydraulic oil and a pressure of 40,000 psi was applied producing a bar with a density of 35% of theoretical. The bar was sintered at 400 C. for 2.5 hours, causing the density to increase to 60 percent of the theoretical density. The cylinder was bored out to an I.D. of 3.5 cm and weighed 65 g. The pore size was 40±4 microns and the porosity distribution was extremely uniform. The hollow cylinder was filled with a standard aluminized high explosive known as H-6 which comprises 45 wt. percent of RDX, 30 wt. percent of TNT, 20 wt. percent of aluminum, 5 wt. percent of nitrocellulose containing wax, and 0.5 wt. percent of calcium chloride. The cylinder was sealed with solid aluminum plates.

A cylinder of aluminum foam with an initial density of about six percent was bored out and pressed axially and radially to a density of about 50 percent of theoretical density. The pore size was 200±175 microns and the porosity distribution was poor. The final dimensions of the cylinder were 3.5 cm in I.D., and 2 cm in length and the weight was 66 g. The cylinder was filled with the aforedescribed explosive and sealed in the same manner as the previous cylinder.

A non-porous aluminum tube measuring 3.5 cm in I.D. and 2 cm in length, was also filled with aforesaid explosive and sealed in the same manner as the other samples.

EXPERIMENTAL SECTION III

Results

Table I summarizes the relative static chamber pressure resulting from detonating the charge warhead casings of Section I.

TABLE I

| | |
|---|---|
| Sintered Al—Mg | 1.9 |
| Al Foam | 1.7 |
| Solid Al | 1.0 |

The warhead casing prepared by the present method had about a twelve percent improvement in the relative static chamber pressure over the best previous warhead casing. This result corresponds to an improvement in the internal blast effectiveness of about 12 percent.

The improvement in internal blast effectiveness by the warhead casing of the present invention over that of porous aluminum, even though this casing comprises 25 weight percent of the less energetic magnesium, is theorized to result from a better dissolution of the metal oxide in the molten particles of the casing created by the blast and a greater head exposure to the particles created by the blast.

In summary a warhead casing prepared by the presently disclosed method is a strongly fused mixture of aluminum, magnesium, and alloys of the two, having an extremely uniform porosity and a pore size small enough and dense enough to greatly reduce the absorbance of water by the material. This strongly fused mixture increases the internal blast effectivenss of an explosive more than any other known casing by a substantial amount.

Obviously many modifications and variations of the present invention are possible in light of the above teachings. It is therefore to be understood that within the scope of the appended claims the invention may be practiced otherwise than as specifically described.

What is claimed is:

1. A method of fabricating warhead casings which comprises the following steps in order:

(1) mixing magnesium powder and aluminum powder in a Mg-Al weight ratio from about 22:78 to about 28:72, said magnesium and aluminum powder having an average particle size within about 80 percent of each other and having an average particle size less than about 150 microns;

(2) isostatically pressing said powder mixture into a preform with the configuration of said warhead casing with a density from about 20 to 40 percent of the theoretical density;

(3) releasing said pressure;

(4) heating said preform at a temperature from about 350 C. to about 425 C. in an inert atmosphere until said preform reaches a density from about 60 to about 70 percent of the theoretical density;

(5) cooling said preform to room temperature.

2. The method of claim 1 wherein said powders are mixed in a Mg-Al weight ratio from 24:76 to 26:74.

3. The method of claim 2 wherein said powders are mixed in a weight ratio of 25:75.

4. The method of claim 2 wherein the particle size of said powders is less than 100 microns.

5. The method of claim 2 wherein said powder mixture is isostatically pressed to a density from 30 to 35 percent of theoretical density.

6. The method of claim 4 wherein said powder mixture is isostatically pressed to a density from 30 to 35 percent of theoretical density.

7. The method of claim 1 wherein said compact is heated to a temperature from 375 C. to 400 C.

8. The method of claim 2 wherein said compact is heated to a temperature from 375 to 400 C.

9. The method of claim 6 wherein said preform is heated to a temperature from 375 to 400 C.

10. The method of claim 8 wherein said preform is heated until the density reaches 63 to 68 percent of theoretical density.

11. The method of claim 9 wherein said preform is heated until the density reaches 63 to 68 percent of theoretical density.

12. The method of claim 3 wherein said preform is heated at a temperature from 375 to 400 C. until the density of said compact reaches 63 to 68 percent of theoretical density.

13. A hollow warhead casing having walls comprising uniformly distributed sintered aluminum particles and magnesium particles wherein (1) the weight ratio of magnesium to aluminum is from about 22.78 to about 28:72;

(2) the average size of the aluminum particles and of the magnesium particles is less than about 150 microns;

(3) the aluminum and magnesium have an average particle size within about 80 percent of each other; and (4) the warhead casing has a density of from about 60 to about 70 percent of the theoretical density.

14. A warhead casing prepared by the method of claim 1.

15. A warhead casing prepared by the method of claim 4.

16. A warhead casing prepared by the method of claim 7.

17. A warhead casing prepared by the method of claim 11.

18. A warhead casing prepared by the method of claim 12.

19. The method of claim 1 wherein said mixture of powders is isostatically pressed in step (2) into a preform not in a configuration of a warhead and wherein the following step is added after step (5):

(6) machining said preform to obtain a warhead configuration.

20. The hollow warhead casing of claim 13 wherein the weight ratio of magnesium to aluminum is from 24:76 to 26:74.

* * * * *